US010890396B2

(12) United States Patent
Taylor

(10) Patent No.: US 10,890,396 B2
(45) Date of Patent: Jan. 12, 2021

(54) SLOTTED TRIGGER ACTUATION

(71) Applicant: Sig Sauer, Inc., Newington, NH (US)

(72) Inventor: Matthew A Taylor, Barrington, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/371,292

(22) Filed: Apr. 1, 2019

(65) Prior Publication Data

US 2019/0310043 A1 Oct. 10, 2019

Related U.S. Application Data

(60) Provisional application No. 62/652,606, filed on Apr. 4, 2018.

(51) Int. Cl.
*F41A 19/31* (2006.01)
*F41A 19/12* (2006.01)

(52) U.S. Cl.
CPC ..... *F41A 19/31* (2013.01); *F41A 19/12* (2013.01)

(58) Field of Classification Search
CPC ..... F41A 19/10; F41A 19/12; F41A 19/15; F41A 19/30; F41A 19/31; F41A 19/32; F41A 17/46
See application file for complete search history.

(56) References Cited

U.S. PATENT DOCUMENTS 1,297,859 A * 3/1919 Johnson ..... F41A 19/10 42/69.01
1,382,313 A * 6/1921 Ortgies ..... F41A 19/12 89/145
3,577,827 A * 5/1971 Billett ..... F41A 17/56 89/145
3,949,508 A * 4/1976 Elkas ..... F41A 17/62 42/69.03
4,185,537 A * 1/1980 Hayashi ..... F41A 19/44 89/145
4,841,840 A * 6/1989 Agner ..... F41A 17/72 42/70.08
5,225,611 A * 7/1993 Scott ..... F41A 19/23 42/42.03
2011/0232150 A1* 9/2011 Zukowski ..... F41A 19/10 42/69.01
2013/0040051 A1* 2/2013 Mourou ..... B29C 45/73 427/128
2013/0340309 A1* 12/2013 Lee ..... F41A 19/16 42/69.01
2014/0215880 A1* 8/2014 Zukowski ..... F41A 17/56 42/70.02
2016/0377363 A1* 12/2016 Lipowski ..... F41A 19/10 42/69.01

FOREIGN PATENT DOCUMENTS

WO WO-0065295 A1 * 11/2000 ..... F41A 19/10

* cited by examiner

*Primary Examiner* — Gabriel J. Klein
(74) *Attorney, Agent, or Firm* — Finch & Maloney PLLC

(57) ABSTRACT

An apparatus and method for a slotted trigger actuation mechanism for a firearm are described herein. The slotted trigger actuation mechanism may be a slotted trigger bar interface. The slotted trigger bar interface may serve to increase a distance of trigger pull required to execute firing ammunition. A trigger body may comprise a trigger bias for increasing trigger work. The apparatus and method described herein may help to improve results during drop safety testing.

19 Claims, 12 Drawing Sheets

SLOTTED TRIGGER ACTUATION

CROSS-REFERENCE TO RELATED APPLICATIONS

This application claims priority under 35 USC § 119(e) to U.S. Provisional Patent Application No. 62/652,606 entitled "Slotted Trigger Actuation," filed on Apr. 4, 2018, which is incorporated by reference herein in its entirety.

FIELD OF THE DISCLOSURE

The present disclosure relates generally to firearms, and more specifically to firing safety mechanisms for a firearm.

BACKGROUND

Firearms design involves many non-trivial challenges. In particular, projectile weapons, such as small arms pistols, have faced a challenge to increase the overall safety and reduce unintended discharge of the firearm.

Existing safety devices include after-market equipment purchased separately from the firearm. These devices include gun safes, trigger locks, and other devices. Firearms generally include one or more built-in safety mechanisms, some of which require user input to be effective.

SUMMARY OF THE DISCLOSURE

The present disclosure provides a slotted interface between a trigger and a trigger bar such that initial rearward motion of the trigger does not result in the trigger bar moving toward the sear. The improved trigger interface may be implemented in a firearm. The present disclosure also provides a trigger bias mechanism to bias the trigger toward a muzzle end of the firearm. Firearm, as used herein, may refer to a pistol or a rifle. Firearm, as used herein, may also refer to a striker-fired pistol such as the SIG SAUER® P320, for example. As used herein, the muzzle end of the firearm may be referred to as the distal end and the back end of the firearm may be referred to as the proximal end.

Accordingly, pursuant to one aspect of the present disclosure, there is contemplated a firearm, comprising a firearm receiver, a fire control group installed in the firearm receiver and comprising a striker configured to engage ammunition chambered in the firearm, a sear mechanically coupled to the striker, a trigger bar mechanically coupled to the sear, and a trigger assembly with a trigger body pivotable between a resting position and a firing position, wherein the trigger body is configured to be movable between a resting position, an intermediate position and a firing position, the sear in a first position when the trigger body is in either the resting position or the intermediate position, and the sear is in a second position different from the first position when the trigger body is in the firing position, the intermediate position being at least 2 mm from each of the resting position and the firing position.

The firearm may be further characterized by one or any combination of the features described herein, such as an arm connected to the trigger body and extending generally opposite of the trigger body from a pivot axis, the arm disposed in operational engagement with the trigger bar, the arm defines a protrusion extending generally parallel to the pivot axis and wherein the trigger bar defines a slot configured to receive the protrusion and guide the protrusion to move within the slot between a proximal slot end and a distal slot end, the trigger bar defines a protrusion extending generally parallel to the pivot axis and wherein the arm defines a slot configured to receive the protrusion and guide the protrusion to move within the slot between a proximal slot end and a distal slot end, the protrusion is configured to slide proximally and distally within the slot, the protrusion is configured to act as a fulcrum to lever trigger movement against an opposed motion of the trigger bar, the slot is an oval-shaped slot or a rectangular slot with two rounded ends, a trigger bias configured to bias the trigger body towards the resting position, the trigger bias is a spring disposed between a trigger stop on the firearm receiver and a proximal portion of the trigger body.

Pursuant to another aspect of the present disclosure, there is contemplated a firearm, comprising a trigger body, and a sear, mechanically coupled to the trigger body, wherein the trigger body is configured to be movable between a resting position, an intermediate position and a firing position, the sear is in a first position when the trigger body is in either the resting position or the intermediate position, and the sear is in a second position different from the first position when the trigger body is in the firing position, the intermediate position being at least 2 mm from each of the resting position and the firing position.

The firearm may be further characterized by one or any combination of the features described herein, such as a trigger bar configured with a slot at an interface between the trigger body and the trigger bar, wherein the trigger body is configured to be movable between a resting position, an intermediate position, and a firing position, the trigger bar is in a first position when the trigger body is in either the resting position or the intermediate position, and the trigger bar is in a second position different from the first position when the trigger body is in the firing position, a proximal portion of the trigger body is configured to receive a bolt extending from a pin in the firearm receiver, surrounded at least in part by a trigger bias, the trigger bias is configured to require a pullback force of greater than about 9 lbs. to enable motion of the trigger body, only a portion of rearward trigger movement causes longitudinal movement of the trigger bar.

Pursuant to yet another aspect of the present disclosure, there is contemplated a method, comprising providing a firearm, comprising a firearm receiver, a fire control group installed in the firearm receiver and comprising a striker configured to engage ammunition chambered in the firearm, a sear mechanically coupled to the striker, a trigger bar mechanically coupled to the sear, and a trigger assembly with a trigger body pivotable between a resting position and a firing position, grasping the trigger body, pulling back on the trigger body to a first distance, pulling back on the trigger body to a second distance, and longitudinally moving the trigger bar only after the trigger body has been pulled back to the second distance.

The method may be further characterized by one or any combination of the features described herein, such as movement of the trigger body to the first distance does not result in trigger bar motion toward the sear, a first distance is between about 3 mm and about 5 mm, wherein a second distance is greater than about 5 mm.

Pursuant to yet another aspect of the present disclosure, there is contemplated a method, comprising providing a firearm, comprising a trigger body, and a sear, mechanically coupled to the trigger body, grasping the trigger body, pulling back on the trigger body to a first distance, pulling back on the trigger body to a second distance, and actuating the sear only after the trigger body has been pulled back to the second distance.

The method may be further characterized by one or any combination of the features described herein, such as movement of the trigger body to the first distance results in no movement of the sear.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

DESCRIPTION OF THE DRAWINGS

The drawings described herein are for illustration purposes only and are not intended to limit the scope of the present disclosure in any way.

DETAILED DESCRIPTION

Figure 1:
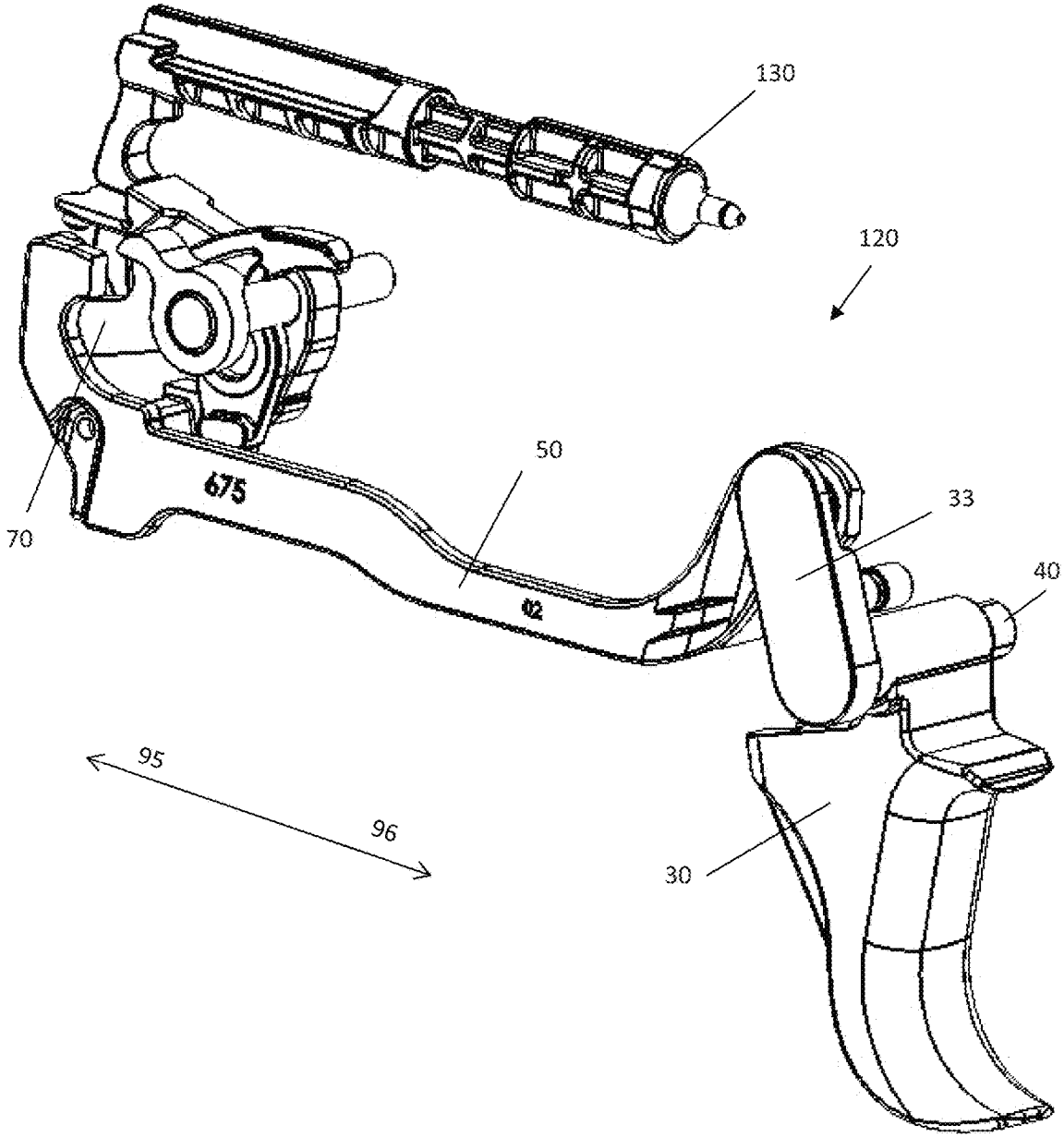
FIG. 1 illustrates a top, right-side, and front perspective view of one embodiment of a fire control group of the present disclosure.

Known firing mechanism designs use a pivoting connection between a trigger and a trigger bar such that motion of the trigger is immediately transferred to the trigger bar. Some small radial clearances may be typically required at the joint between the trigger and the trigger bar, however movement of the trigger necessarily transfers force to a trigger bar upon depression of the trigger.

The sear of a firearm functions to hold the hammer or striker back under the tension of a spring. When the trigger bar of the gun is pulled, the sear disengages from the hammer or striker, allowing the hammer or striker to move forward to a firing position. When the user pulls the trigger in a loaded striker-fired pistol, for example, the sear disengages from the striker held in a cocked, rearward position under spring tension. After disengagement from the sear, the striker moves forward and strikes the ammunition primer.

In firearms, a safety or safety catch is a mechanism used to help prevent the accidental discharge of a firearm. Safeties can generally be classified as internal safeties or external safeties. Internal safeties typically do not receive input from the user. In contrast, external safeties typically require user input, for example, by toggling a switch between "safe" and "fire." Some firearms include mandatory integral locking mechanisms that must be deactivated by a unique key before the gun can be fired. These integral locking mechanisms are intended as child-safety devices during unattended storage of the firearm—not as safety mechanisms while carrying or using the firearm.

Known gun safety mechanisms include, for example, a safety lever, safety wing, action release, hammer block safety, trigger block safety, bore lock safety, grip safety, and a trigger lock safety. For example, trigger locks physically prevent the trigger from being pulled to discharge the weapon. Trigger locks generally have two pieces extending from either side of the lock that come together behind the trigger to obstruct the trigger movement. The trigger locks may be locked in place and unlocked with a key or combination. In order to be effective, however, trigger locks require the user to install the trigger lock in the trigger guard and place it in a locked condition. Since trigger locks require user action and are not built into the mechanical structure of the firearm itself, a trigger lock may be less likely to prevent unintentional discharge of the firearm. Also, trigger locks are generally designed to be used during firearm storage, not when the firearm is in use or carried by the user.

Another example is a safety lever on a trigger, which is a type of safety designed to prevent unintentional discharge when the firearm is in use, such as when the firearm is carried on the user or in the user's hand. The safety lever must be manually depressed before the trigger can be moved and cause movement of a trigger bar to discharge the firearm. However, when the user's finger is on the trigger with the safety lever depressed, the firearm may still discharge unintentionally if the user's hand or body is bumped since a slight movement of the trigger may be sufficient to fire the firearm. Thus, there is a need for an improved firearm design configured to reduce unintended firing.

Embodiments of the present disclosure attempt to overcome certain limitations of safety mechanisms known in the art and relate to an apparatus and method for limiting or preventing unintentional discharge of a firearm. Embodiments of the present disclosure also relate to an apparatus and method of use for a slotted interface between a trigger and a trigger bar. Embodiments of the present disclosure also relate to a slot on a trigger bar and method of use. Embodiments of the present disclosure also relate to a method of delaying the onset of trigger bar motion during rearward motion of the trigger. Embodiments of the present disclosure further relate to improvements in drop safety for firearms. Numerous configurations and variations will be apparent in light of this disclosure.

As will be seen, the devices and methods taught herein offer a solution to the problem of firearm safety. The devices and methods taught herein are intended to avoid unintended discharge, as well as the consequences of firearm malfunctions. Improving firearm safety may help to eliminate or minimize the risks of unintentional death, injury or damage caused by improper handling of firearms. The devices and methods taught herein may help to improve results during drop safety tests.

It is contemplated that it would be advantageous to minimize or reduce the inertia of fire control components when the firearm is dropped or otherwise subjected to a sudden force. It is also contemplated that it may be desirable to provide an opposing force to trigger movement, i.e. trigger work, in combination with increased trigger travel to provide an improved safety mechanism. It is also contemplated that a trigger bar that requires increased trigger travel may help to reduce unintended movement of the trigger bar, and therefore unintended discharge of the firearm. It is further contemplated that it may be desirable to increase steadiness of different components within a firearm in order to reduce a statistical likeliness that the firearm will unintentionally fire. It is still further contemplated that the firearm equipped with the drop safety mechanism of the present disclosure would meet SAAMI, NATO EPVAT, as well as German drop safety standards.

It would be advantageous in view of the above discussion to provide systems and methods for an improved trigger actuation mechanism capable of meeting the above-identified needs. Such a system would provide a firearm with improved drop safety and a reduction in unintentional firing. It would be desirable to provide an improved safety mechanism such as the slotted trigger actuation mechanism described herein. The slotted trigger actuation mechanism may include a trigger bar provided with a slot therein and a trigger with a protrusion extending therefrom which slides within the slot to cause a delay in the onset of trigger bar motion and therefore a mechanical delay in actuation of the striker. In some embodiments, a force acting on the trigger is opposed by a counteracting force acting on the trigger bar. Similar to a first-class lever, each of the trigger and the trigger bar have opposite directions of force about a pivot. In some embodiments, movement of the trigger mechanism may be divided into several distinct phases. In a first phase, or resting phase, the trigger has not yet been pulled. In subsequent phases, a protrusion from an arm extending upwards from the trigger may move from a proximal, or stock, end of a slot in the trigger bar during the resting phase to a distal, or muzzle, end, of the slot in the trigger bar as the trigger is activated. The distance the trigger travels in order to move the protrusion from the proximal end of the slot to the distal end of the slot is the increased trigger travel distance described herein. The minimum trigger travel distance can be defined as the distance the trigger travels from a resting position to a position in which a protrusion extending from an arm of the trigger abuts a distal end of the slot. The minimum trigger travel distance can also be defined as a minimum pull distance on the trigger before other components in the fire control group are engaged and/or moved. Until the minimum trigger travel distance is reached, movement of the trigger does not move the trigger bar longitudinally. Similarly, until the minimum trigger travel distance is reached, such that the protrusion abuts a distal end of the slot in the trigger bar, movement of the trigger does not result in movement of the trigger bar, sear, or striker.

Trigger travel distance can be defined as the distance required for a user to pull back on the trigger before inducing the firearm to fire. The slotted interface allows motion of the trigger due to inertial effects such as those encountered during drop testing, without necessarily inducing motion of the trigger bar. In a last phase, the trigger has been pulled backwards beyond the minimum trigger travel distance and the fire control group has been activated such that the trigger bar releases the sear which releases a lever and causes the striker to fire, thus releasing ammunition from the firearm. The distinct phases of activation of the fire control group are described below in more detail.

Also, it should be noted that, while generally referred to herein as a 'slotted trigger actuation mechanism' for consistency and ease of understanding the present disclosure, the disclosed slotted trigger actuation mechanism is not limited to that specific terminology and alternatively can be referred to, for example, as a slotted trigger bar or other terms. As will be further appreciated, the particular configuration (e.g., materials, dimensions, etc.) of a trigger actuation mechanism configured as described herein may be varied, for example, depending on whether the target application or end-use is military, tactical, or civilian in nature. Numerous configurations will be apparent in light of this disclosure.

It also would be advantageous in view of the above discussion to provide systems and methods for an improved trigger actuation mechanism capable of meeting the above-identified needs. It would be desirable to provide an improved safety mechanism such as the mechanism for increasing trigger work required to activate the fire control group as described herein. In some embodiments, a bias device or spring may be provided to increase trigger work. The bias device or spring may require additional force from a user before initiating firing via the fire control group. The spring load applied directly to the trigger may keep the trigger from 'rattling' through the range of motion allowed by the slot in the trigger bar. The load from such springs would always be applied to the trigger before the trigger bar spring loads were applied to the trigger, as the trigger is moved from a resting position to a firing position. It is contemplated that the spring may be a compression spring, a torsion spring, or any other type of spring. In some embodiments, the spring may make contact with a region at the proximal end of the trigger, bias the trigger toward a forward position, and/or require additional force from a user in depressing the trigger before initiating firing. In some embodiments, the spring may be a torsion spring which provides a resistive force at the pivot point between the trigger and a disconnector such as the trigger bar.

In some embodiments, a spring biases the trigger forward in a resting state. When the trigger is positioned in a first, forward position a protrusion extending from an arm that extends upwards from the trigger is positioned at the back of the slot in the trigger bar. In an intermediate position, as the trigger is initially pulled backwards (i.e., during pre-travel or "take-up"), the bias device or spring begins to become compressed and the protrusion from the trigger arm moves forward to the front of the slot in the trigger bar. To discharge the firearm, a user continues to pull back on the trigger, compressing the spring, and moving the protrusion of the trigger arm to the front of the slot in the trigger bar until the trigger "breaks" with the sear moving out of engagement with the striker or hammer. The trigger pin may act as a fulcrum between trigger and trigger bar movement. The trigger pin may be configured to be the pivot axis between trigger and the trigger bar.

Figure 2:
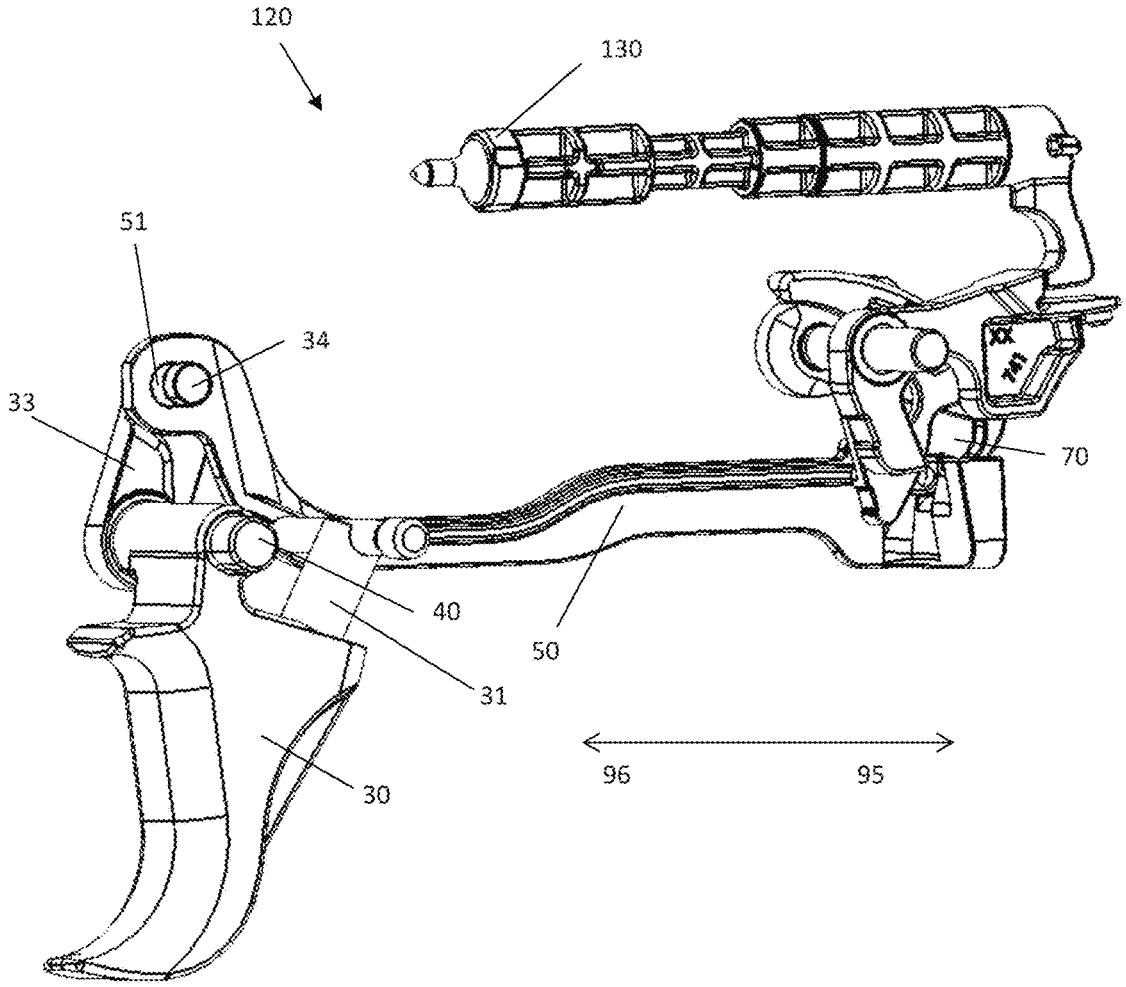
FIG. 2 illustrates a left-side, front perspective view of one embodiment of a fire control group of the present disclosure.
Figure 3:
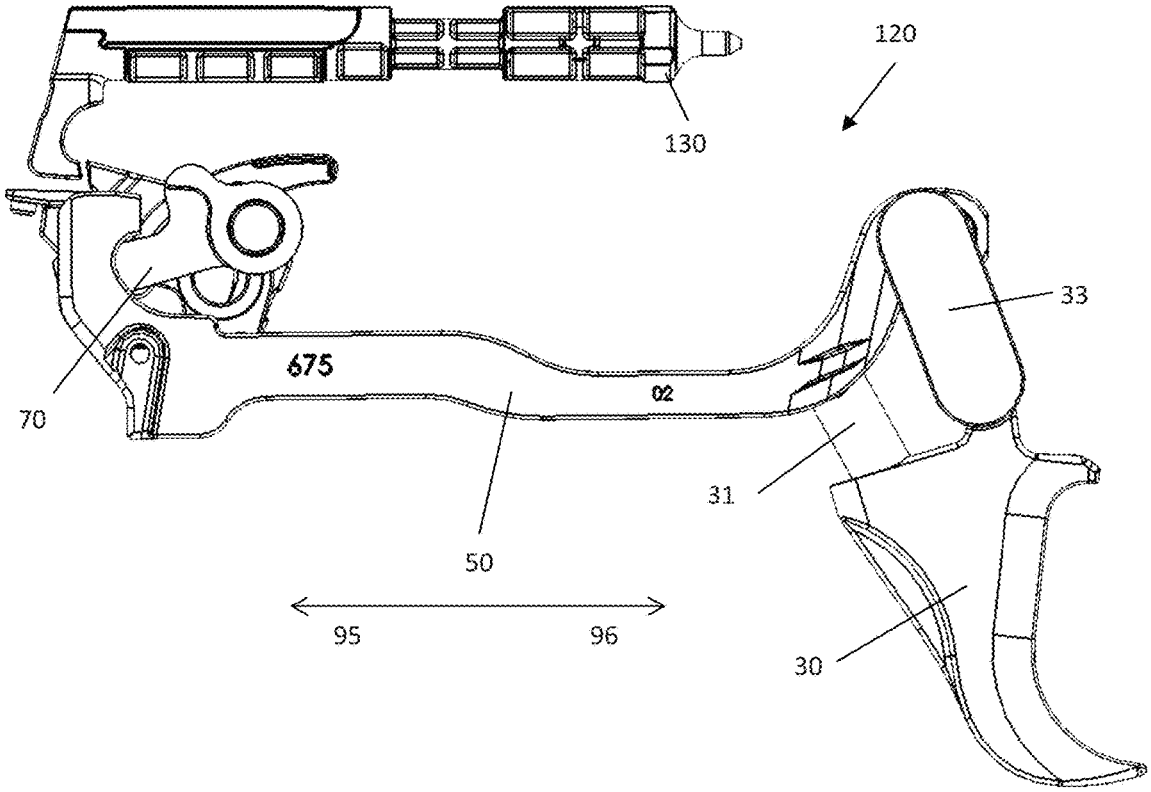
FIG. 3 illustrates a right-side elevational view of one embodiment of a fire control group of the present disclosure.
Figure 4:
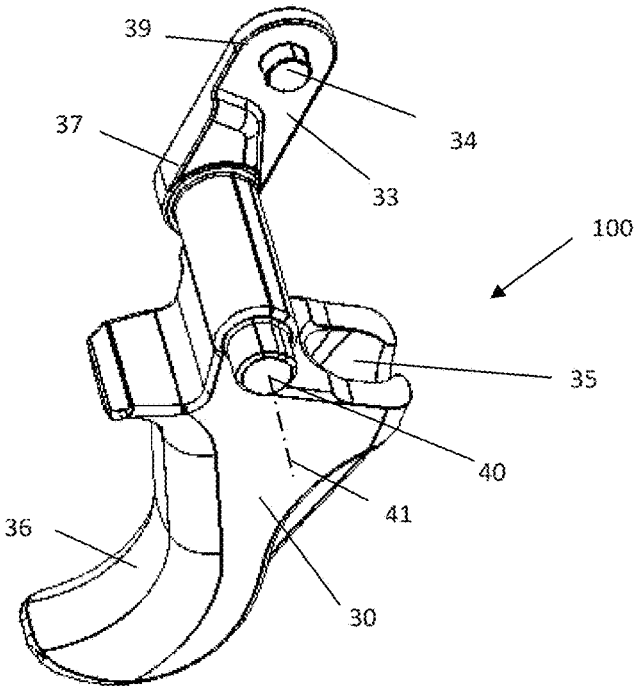
FIG. 4 illustrates a top, left-side, and front perspective view of one embodiment of a trigger of the present disclosure.
Figure 5:
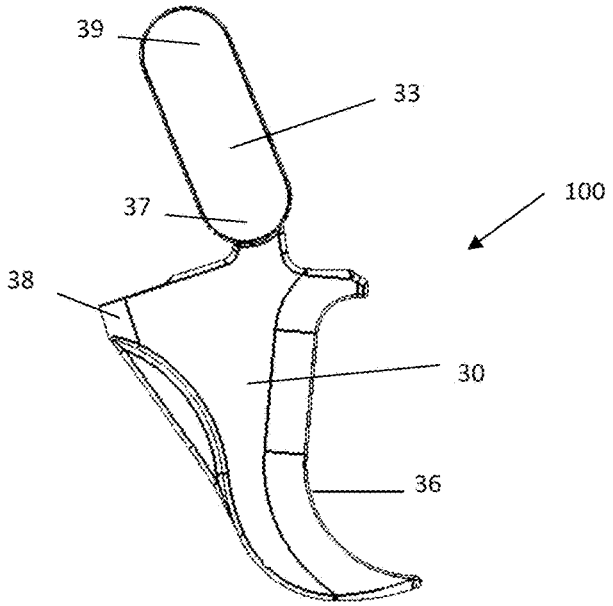
FIG. 5 illustrates a right-side elevational view of one embodiment of a trigger of the present disclosure.
Figure 6:
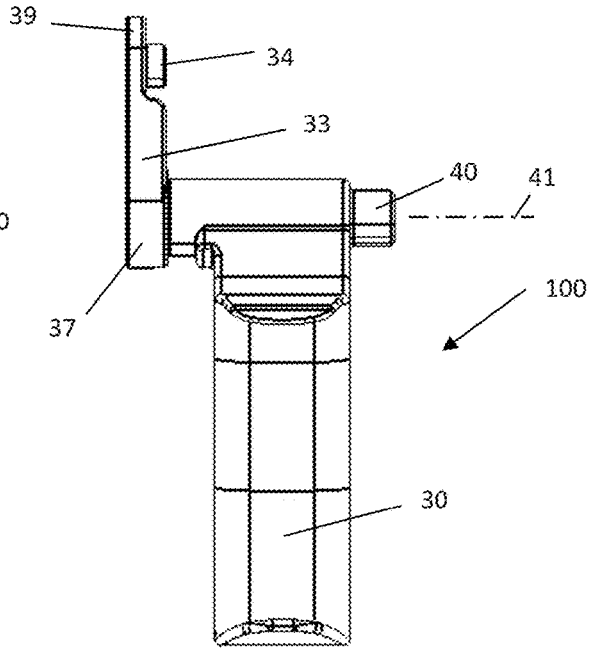
FIG. 6 illustrates a front elevational view of one embodiment of a trigger of the present disclosure.
Figure 7:
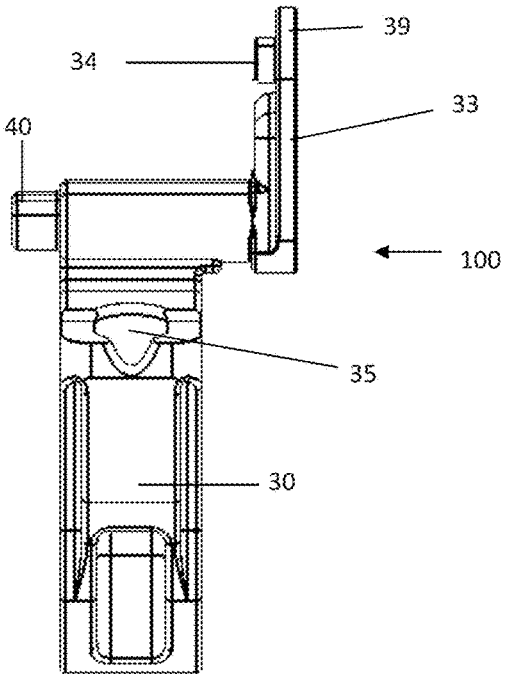
FIG. 7 illustrates a rear elevational view of one embodiment of a trigger of the present disclosure.
Figure 8:
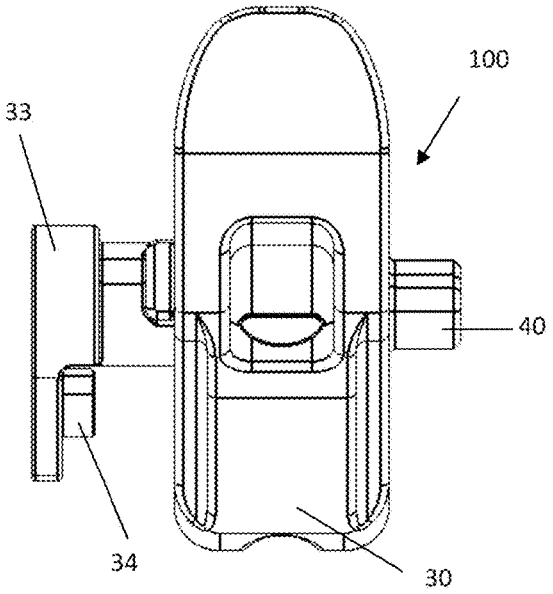
FIG. 8 illustrates a top plan view of one embodiment of a trigger of the present disclosure.
Figure 9:
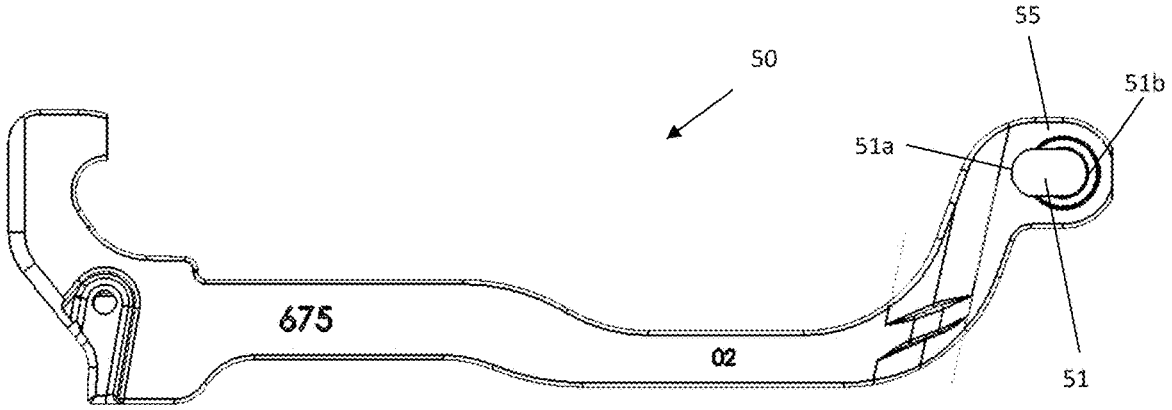
FIG. 9 illustrates a right-side elevational view of one embodiment of a trigger bar of the present disclosure.
Figure 10:
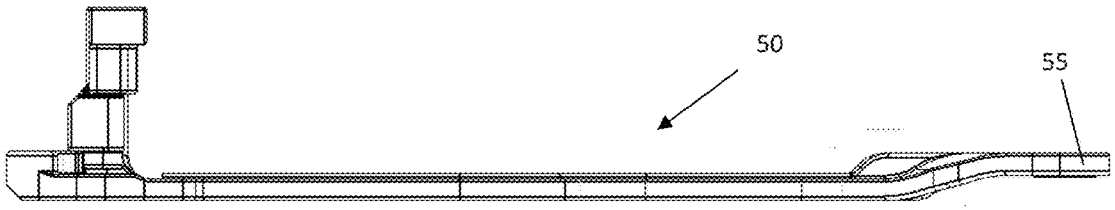
FIG. 10 illustrates a top plan view of one embodiment of a trigger bar of the present disclosure.
Figure 11:
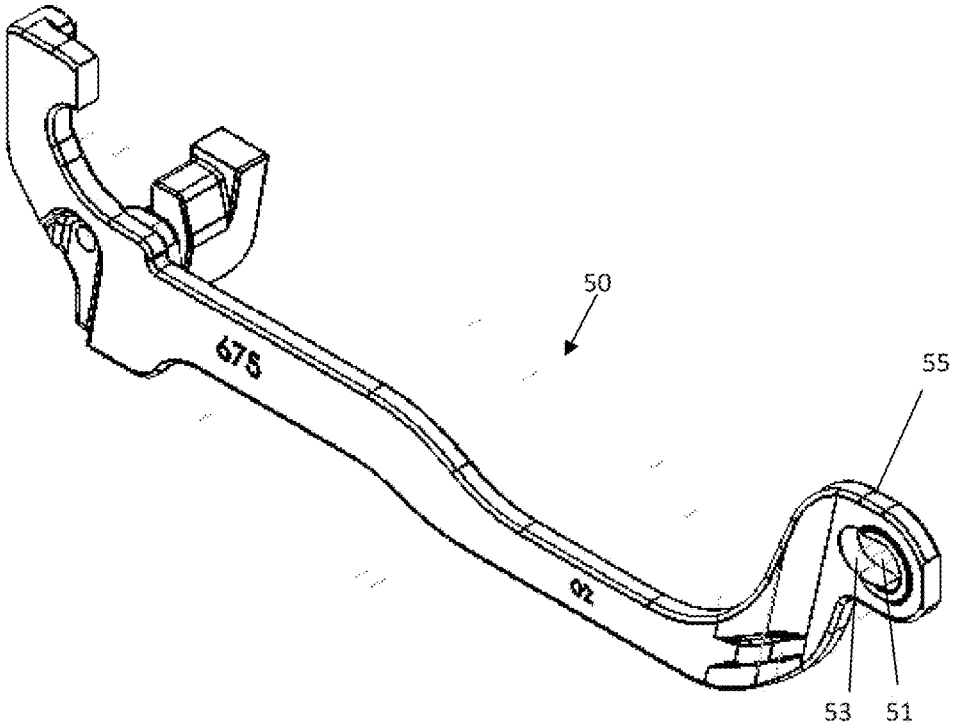
FIG. 11 illustrates a top, right-side, and front perspective view of one embodiment of a trigger bar of the present disclosure.
Figure 12:
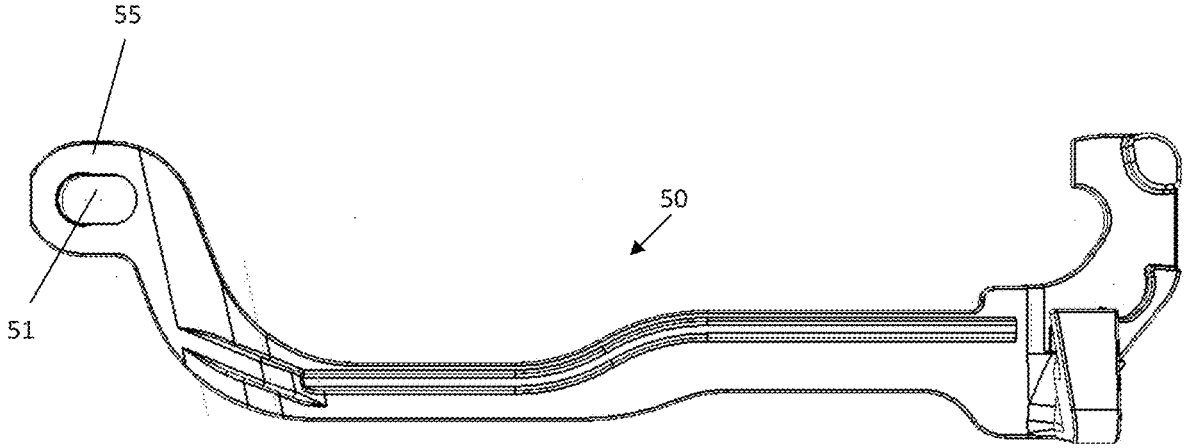
FIG. 12 illustrates a left-side elevational view of one embodiment of a trigger bar of the present disclosure.
Figure 13A:
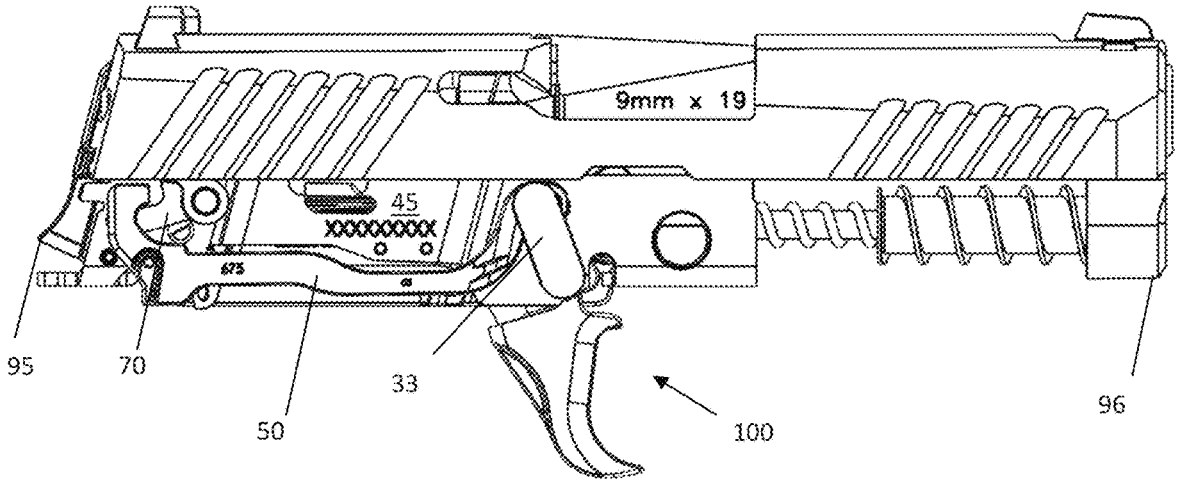
FIG. 13A illustrates a right-side view of a partially disassembled pistol showing the slide, firearm receiver, and trigger assembly, where the trigger is at rest (i.e. in a first phase of trigger movement).
Figure 13B:
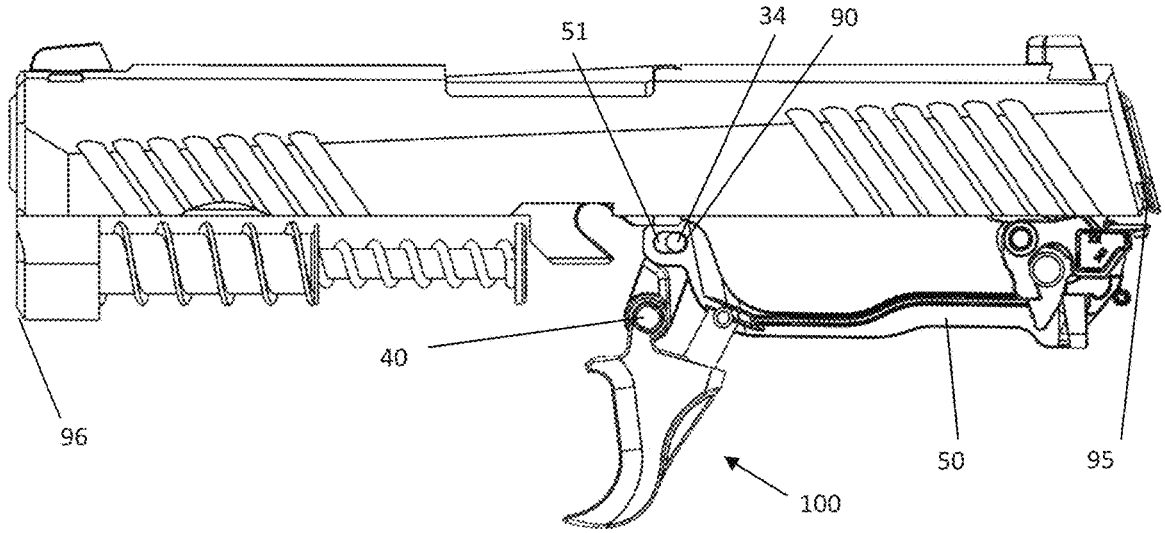
FIG. 13B illustrates a left-side view of the slide, firearm receiver, and trigger assembly of FIG. 3A.

Turning now to the drawings, FIGS. 1-3 detail different views of one embodiment of a fire control group 120 in accordance with the present disclosure. Fire control group 120 includes trigger assembly 100, striker 130, trigger bar 50, and sear 70. Trigger assembly 100 includes trigger body 30 positioned distally and connected by protrusion 34 (see FIG. 2) in arm 33 to mechanically interconnect with trigger bar 50 via slot 51. A disconnector such as trigger bar 50 is activated to cause release of the sear 70. Trigger bar 50 extends between a distal end and a proximal end of fire control group 120 and is mechanically interconnected with sear 70. In the illustrated embodiment, as trigger body 30 is pulled backwards proximally as it rotates about trigger pin 40 and causes trigger bar 50 to be pulled distally and pivot sear 70, thereby releasing striker 130 and releasing ammunition from the firearm. The term striker includes a striker as known in striker-fired firearms, a firing pin, a hammer, or other structure configured to contact and cause chambered ammunition to fire.

Slotted Trigger Actuation

Slotted trigger actuation may refer to a slot or gap in a component of fire control group 120 that creates a mechanical delay in activation of a firing mechanism. Slotted trigger actuation may refer to slotted trigger bar interface or other slotted interface within fire control group 120 that provides a delay in a mechanical response of a firing mechanism due to a space created at the interface with a trigger. In some embodiments, slotted trigger actuation may refer to a slot provided on the trigger and a protrusion provided on the trigger bar.

Functionally, in some embodiments, slot 51 is provided in trigger bar 50 so that the connection between trigger assembly 100 and trigger bar 50 does not induce motion of trigger bar 50 initially in the direction that it would bring the firearm closer to firing. During initial rearward motion of trigger body 30, trigger bar 50 may rotate slightly upward or downward but is not pulled forward to act on sear 70 and bring the firearm closer to firing. Functionally, slot 51 in trigger bar 50 increases the distance of trigger travel required before the firearm fires. Trigger travel distance can be defined as the distance required for a user to pull back on trigger body 30 from a resting position to a position where sear 70 releases the hammer or striker 130. Slot 51 in trigger bar 50 may increase trigger travel distance without changing the distance that trigger bar 50 moves. In other words, slot 51 in trigger bar 50 increases trigger pre-travel or take-up before movement of trigger assembly 100 causes trigger bar 50 to act on sear 70. Functionally, the slotted trigger bar interface may reduce the statistical likeliness that the gun will discharge when dropped or when trigger body 30 is slightly depressed inadvertently. Functionally, slot 51 in the trigger bar 50 requires trigger body 30 to travel a predefined minimum trigger travel distance before movement of trigger body 30 causes trigger bar 50 to move longitudinally.

Structurally, in some embodiments, the slotted trigger bar interface may comprise a groove or slot 51 defined in or through trigger bar 50 at the location where protrusion 34 of arm 33 mates with trigger bar 50. It is contemplated that slot 51 may have a slot length between 1.05 times and 3 times, between 1.2 and 2.5, or between 1.3 and 1.5 times the diameter of protrusion 34. It is contemplated that the slot 51 can be in a front-end portion 55 of trigger bar 50. Slotted trigger bar interface disconnects trigger body 30 from a direct mechanical relationship, a one-to-one relationship, or both, with the trigger bar 50 at certain points during trigger motion.

Functionally, in some embodiments, motion of trigger assembly 100 may not be directly connected to motion of trigger bar 50, may not be in a one-to-one relationship with a trigger bar 50, or both. In other words, embodiments of the present disclosure require some rearward movement of trigger body 30 prior to translational movement of trigger bar 50 towards a firing position.

FIGS. 4-8 detail different views of one embodiment of trigger assembly 100, including trigger body 30 pivotable about a pivot axis 41 and having a trigger body 30 and an arm 33 with a protrusion 34. Trigger body 30 pivots about a pivot axis 41 extending laterally through the firearm receiver 45 in a direction perpendicular to the bore axis 93. For example, trigger body 30 pivots about a trigger pin 40. Trigger body 30 has a distal surface 36 configured for engagement by a user's finger. The distal surface 36 typically has a concave curvature, but may be straight in some embodiments. Trigger body 30 has a proximal portion 38 that defines a recess or engagement surface 35 for a trigger bias 32. In some embodiments, a proximal portion 38 of trigger body 30 is configured to receive a bolt 31, surrounded in part by a spring 43 extending from a trigger stop, such as a pin or block in the firearm receiver 45. The bolt 31 and the spring 43 may extend into an engagement surface 35 within trigger body 30. In other embodiments, a torsion spring may be configured around pivot axis 41 of trigger body 30 to provide an opposing force or a resistance to trigger movement. For example, a torsion spring may be configured around a trigger pin 40. In still other embodiments, an engagement surface 35 in the trigger may be configured to push against trigger bias 32 which provides a resistive force opposing rearward movement of trigger body 30.

In one embodiment, arm 33 extends away from a pivot axis 41 in a generally opposite direction from trigger body 30. As such, trigger body 30 and arm 33 function as a first-class pivot, where a pivot axis 41 is located between trigger body 30 and arm 33. In some embodiments, arm 33 is positioned about 180° from trigger body 30. Thus, a force (e.g., the user's finger) acting to pivot trigger body 30 in a rearward or proximal direction causes arm 33 to pivot in a forward or distal direction. In other embodiments, arm 33 can be within a sector from 150° to 210° with respect to trigger body 30. In yet other embodiments, arm 33 is positioned in an even broader sector, such as with a sector from 45° to 270° with respect to trigger body 30. In still further embodiments, trigger body 30 is configured as a second-class lever, where protrusion 34 is located generally between a pivot axis 41 and the end of trigger body 30. For example, arm 33 and protrusion 34 are located in a sector from −30° to +30° with respect to trigger body 30. In this embodiment, the fire control group 120 would function by moving trigger bar 50 in a rearward direction when the trigger body 30 is pulled rearwardly.

In one embodiment, arm 33 has a plate-like geometry with a proximal arm portion 37 connected to trigger body 30 adjacent a pivot axis 41 and extending from adjacent a lateral face of trigger body 30. In one embodiment, arm 33 has a protrusion 34 extending from distal arm portion 39 perpendicularly to pivot axis 41 (i.e. extending laterally into the firearm receiver 45). Protrusion 34 is configured to engage a slot 51 defined in trigger bar 50, which is discussed in more detail below. In some embodiments, protrusion 34 is a pin or a rounded extension. Other geometries are contemplated and depend in part on the shape of slot 51 in trigger bar 50. Protrusion 34 may be configured to mate with slot 51.

Figure 18:
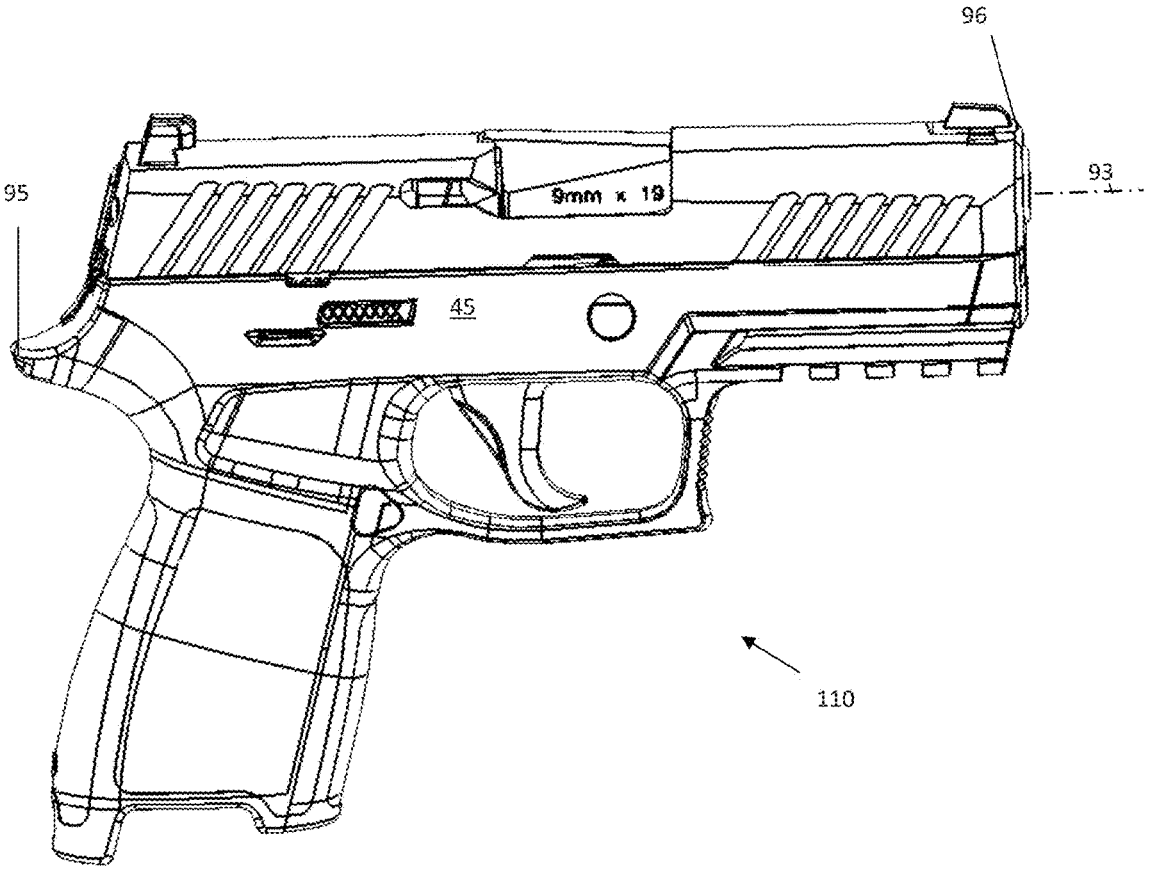
FIG. 18 illustrates an assembly side elevational view of a pistol which includes the slotted trigger actuation of the present disclosure.

FIGS. 9-12 detail different views of one embodiment of trigger bar 50, including slot 51. Slot 51 is a longitudinal through-opening or recess in trigger bar 50 that extends generally parallel to the bore axis 93 (shown in FIG. 18). In some embodiments, slot 51 has a generally oval shape or a generally rectangular shape with rounded ends. For example, as shown in FIG. 9-12, slot 51 is a passage through trigger bar 50 in a lateral direction perpendicular to the bore axis 93. Slot 51 is shaped to receive protrusion 34 and guide protrusion 34 between a slot proximal end 90 to a slot distal end 91 as the trigger body 30 is actuated between a resting position and a firing position. For example, protrusion 34 engages an inner surface 53 of slot 51 and is guided from slot proximal end 90 to slot distal end 91 as the trigger body 30 is actuated from a resting state to a depressed or firing state. Protrusion 34 moves in the opposite direction along slot 51 as trigger body 30 is released and returns to the resting state from a depressed state. In alternative embodiments, slot 51 may be a passage through a portion of trigger assembly 100 and protrusion 34 may be positioned on trigger bar 50. For example, slot 51 may be a cut-out or groove positioned on arm 33.

The slotted trigger actuation mechanism described herein may be configured such that movement of trigger body 30 by a first distance does not result in activation of fire control group 120. The first distance may be between about 1.5 and 3 mm, between about 3 mm and about 5 mm, between about 5 mm and 8 mm, or between about 8 mm and about 15 mm. The slotted trigger actuation mechanism described herein may require movement of trigger body 30 to a second distance for activation of fire control group 120 to occur. A second distance may be greater than about 5 mm, greater than about 6 mm, greater than about 10 mm, or greater than about 15 mm.

FIGS. 13A-16 detail the change in position of trigger body 30, trigger bar 50, and sear 70 as trigger body 30 moves from a forward resting state and is pulled rearward. As trigger body 30 is pulled rearward, different phases of movement of trigger assembly 100 occur to actuate a trigger bar 50, sear 70, or both, in firearm 110, as described below in greater detail.

Motion of Trigger and Trigger Bar

In some embodiments, movement of the trigger mechanism may be divided into six distinct phases. In a first phase, or resting phase, the trigger has not yet been pulled. Protrusion 34 of arm 33 sits in a proximal, or stock, end 90, of slot 51 (see FIG. 13B).

Figure 14:
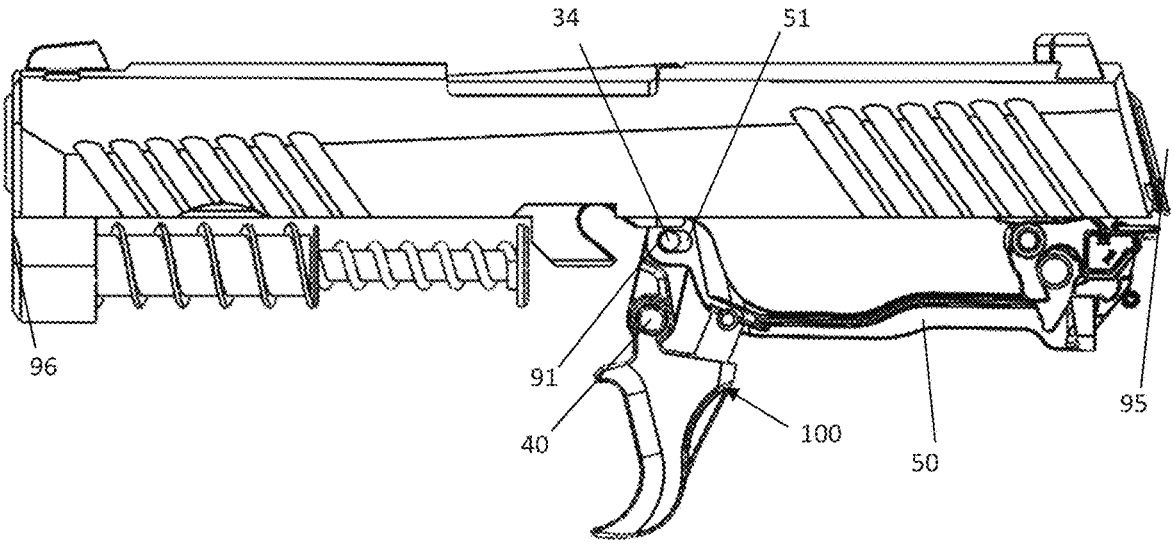
FIG. 14 illustrates a left-side view of the slide, firearm receiver, and trigger assembly of a partially disassembled pistol, showing the trigger in a partially depressed position (i.e. in a second phase of trigger movement).
Figure 15:
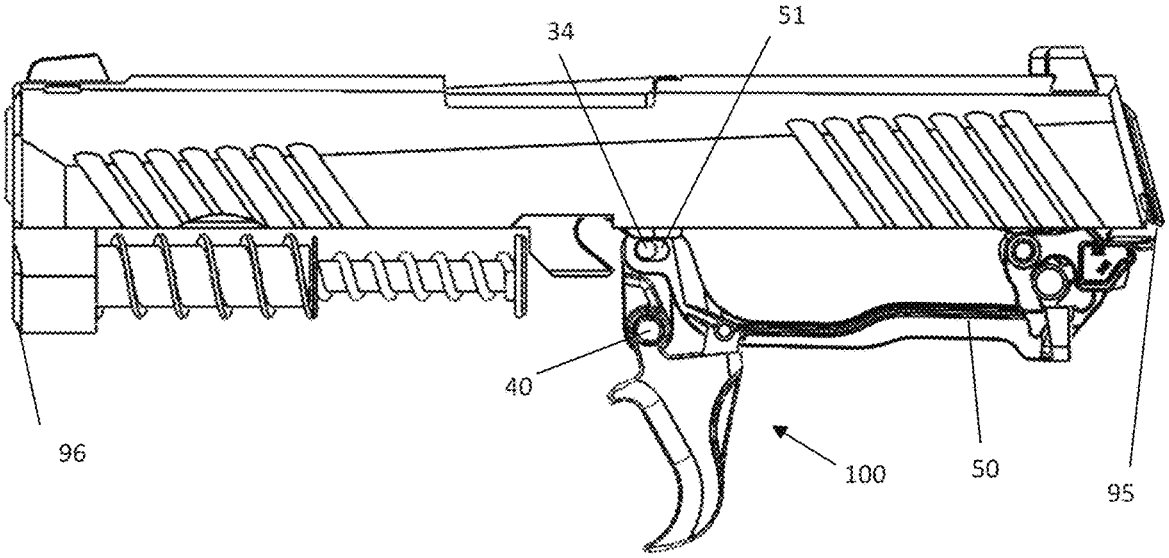
FIG. 15 illustrates a left-side view of the slide, firearm receiver, and trigger assembly of a partially disassembled pistol showing the trigger in another partially depressed position (i.e. in a third phase of trigger movement).

A second phase can be defined as beginning from a trigger rest position and extending until protrusion 34 of arm 33 reaches a distal, or muzzle, end 91, of slot 51 (see FIG. 14). Until the minimum trigger travel distance is reached with protrusion 34 abutting distal end 91 of slot 51, movement of the trigger body 30 does not move the trigger bar 50. The minimum trigger travel distance can be defined as the distance trigger body 30 travels from a resting position to a position in which protrusion 34 of arm 33 abuts distal end 91 of slot 51 (see FIG. 14).

A third phase can be defined as starting when the minimum trigger travel distance of trigger body 30 has been met and where further travel of trigger body 30 results in movement of the trigger bar 50 in a longitudinal direction toward the muzzle or distal end 96 of the firearm. The third phase continues while trigger body 30 moves to make contact with sear 70. The third phase can be defined as ending prior to release of sear 70 (see FIG. 15).

Figure 16:
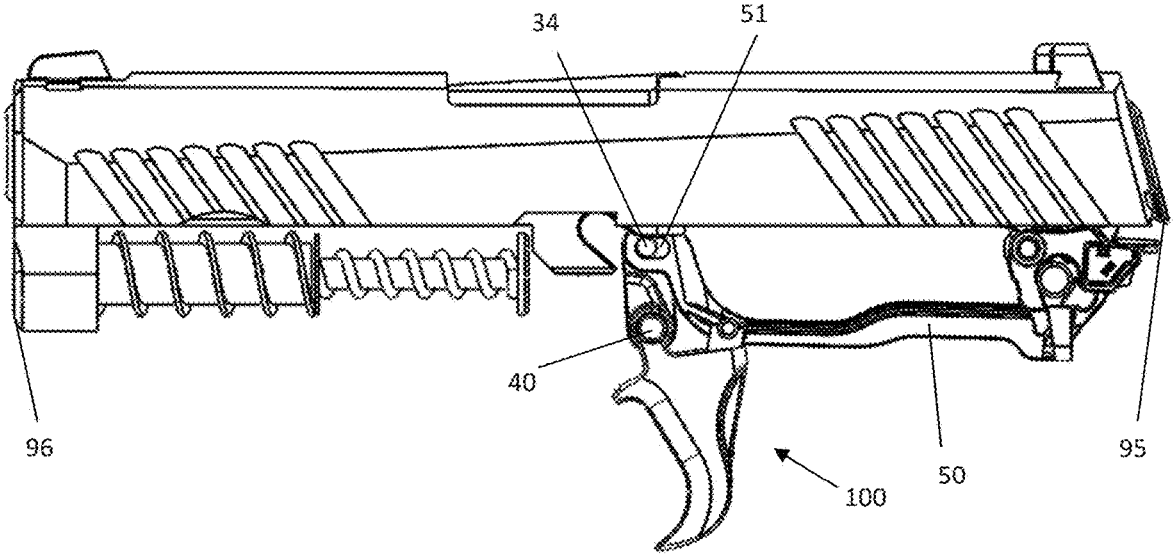
FIG. 16 illustrates a left-side view of the slide, firearm receiver, and trigger assembly of a partially disassembled pistol showing the trigger in a depressed position (i.e. in a fourth phase of trigger movement).

In a fourth phase, sear 70 is released and striker 130 is released to execute firing. In this phase, as the user pulls back on trigger body 30, trigger bar 50 moves in a forward direction toward distal end 96 of the pistol. As trigger bar 50 moves forward, trigger bar 50 makes contact with sear 70 and causes sear 70 to rotate to a firing position. As the sear 70 rotates, engagement with striker 130 is reduced until the point that sear 70 releases striker 130, resulting in ignition of the primer (FIG. 16).

In a fifth phase, a user will typically continue to pull the trigger body 30 back past the point at which sear 70 releases striker 130 and to the point where trigger body 30 contacts a trigger stop. As trigger body 30 is pulled to a fully rearward position, bolt 31 bottoms out at trigger block 60 as bolt 31 extends through a cylindrical channel and contacts engagement surface 35) (see FIGS. 2-3 and FIG. 17).

In a sixth phase, trigger body 30 is released by the user and returns to a resting, or forward, state.

Alternatively, a two phase, three phase, four phase, five, or seven or more phase release is contemplated. In a rifle, for example, a two-phase release is contemplated. In a first phase, the trigger must pass through a first distance before any movement occurs in sear 70. In a second phase, after the trigger reaches a second distance, the trigger disengages sear 70. In this embodiment, the trigger activates sear 70 directly without involvement of trigger bar 50. It is contemplated that trigger body 30 has some movement before it engages or disengages sear 70 prior to firing the rifle.

Functionally, in some embodiments, the direction of trigger movement and the direction of trigger bar 50 movement are opposed. A trigger bar 50 whose motion is opposed to the motion of trigger body 30 may be referred to as a push trigger bar. It is contemplated that this feature may provide an additional level of safety and yield improved performance during drop-safety testing. It is also contemplated that opposed motion of trigger body 30 and trigger bar 50 may help to increase the trigger work required to initiate firing. In order to achieve the increased trigger work, trigger body 30 may act as a lever.

Figure 17:
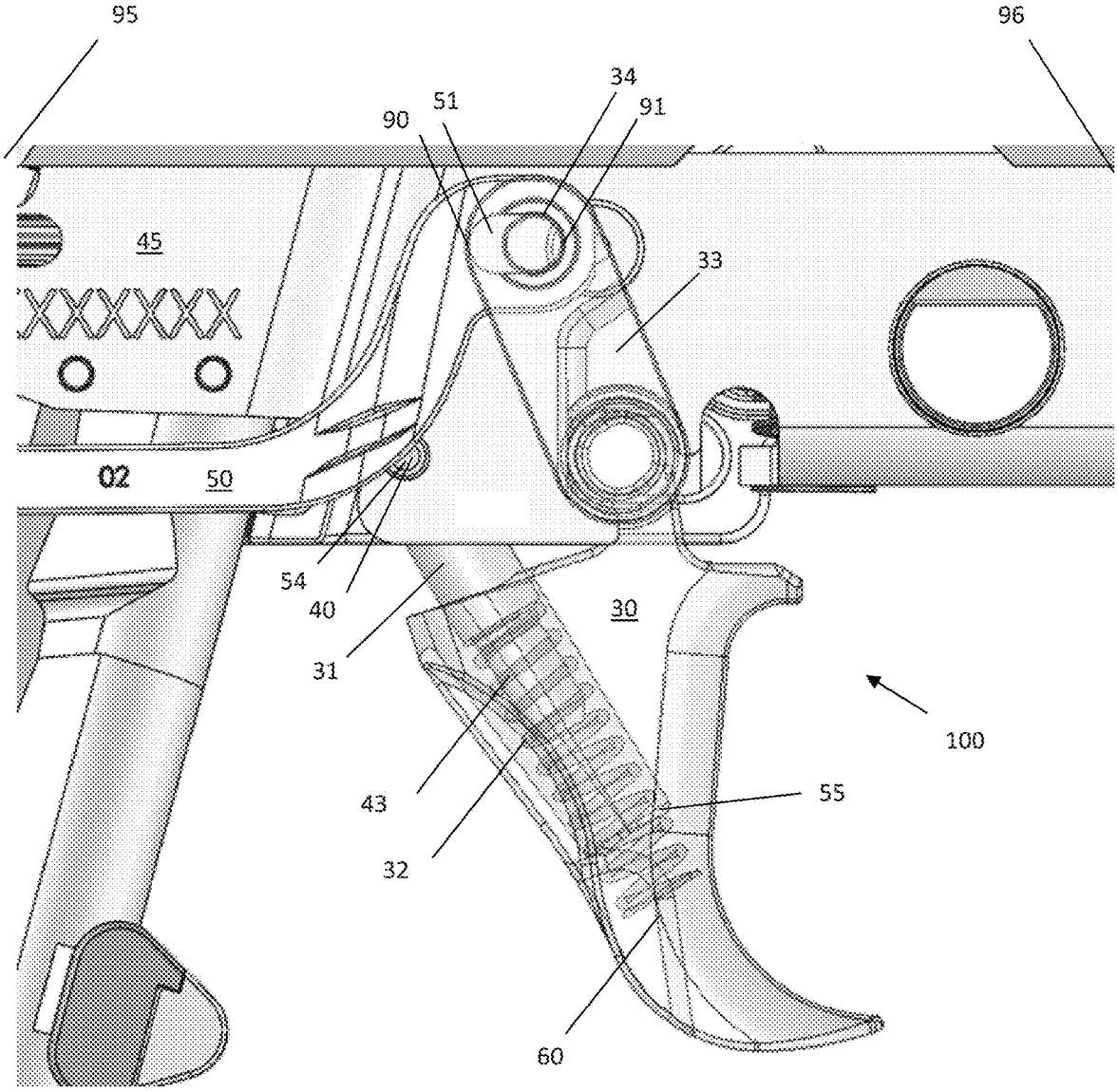
FIG. 17 illustrates a side elevational view of part of a firearm showing one embodiment of a trigger assembly of the present disclosure, where the trigger is partially depressed (i.e. in a second phase of trigger movement).

Structurally, trigger bar 50 and trigger body 30 in a push trigger bar might require a trigger stop or trigger block 60 (i.e. bolt 31 bottoms out at engagement surface 35) (see FIGS. 2-3 and FIG. 17). The trigger block or trigger stop may serve to stop the trigger at a point during trigger pullback after the firearm fires ammunition.

Delayed Engagement of Trigger and Other Components in Fire Control Group

Alternative embodiments are contemplated that provide delayed engagement of the trigger and other components in the fire control assembly. In some embodiments which do not require a trigger bar (i.e. a rifle), a groove or slot may alternatively be provided in a sear to create a similar effect of delayed engagement during trigger activation. In this case, during initial rearward motion of the trigger, the sear may rotate slightly but this change in position does not bring the firearm closer to firing. Functionally, the groove or slot in the sear increases the amount of trigger travel distance required before the firearm fires. The groove or slot in the sear may increase trigger travel distance without changing the distance that the sear moves. Functionally, the slotted sear interface may increase the statistical likeliness that the gun is safe or reduce the statistical likeliness of negligent discharge. Functionally, the groove or slot in the sear may require the trigger body 30 to travel a minimum trigger travel distance before trigger motion begins to move the sear towards a firing position.

It is contemplated that a groove or slot may be placed directly in the sear to facilitate a two-stage trigger activation. Structurally, in some embodiments, the slotted sear interface may comprise a groove or slot punched out of the sear at the location where a protrusion mates with a sear. It is contemplated that slot in the sear may be between 1.05 times and 3 times, between 1.2 and 2.5, or between 1.3 and 1.5 times the diameter of protrusion that mates with the slot. Slotted sear interface disconnects the trigger from a direct mechanical relationship, a one-to-one relationship, or both, with the sear at certain points during trigger motion.

Trigger Bias

Referring now to FIG. 17, a side elevational view of part of a pistol details one embodiment of trigger assembly 100, where trigger body 30 is partially depressed. In some embodiments of the present disclosure, trigger assembly 100 includes spring 43 functioning as trigger bias 32. Functionally, trigger bias 32 requires a user to pull back on trigger body 30 with an additional level of mechanical force. Trigger bias 32 may be configured to provide an additional force required for a user to initiate firing. Trigger bias 32 may act as a primary force resisting trigger pull, a secondary force resisting trigger pull, or a tertiary force resisting trigger pull. In some embodiments, a primary, secondary, or tertiary force resisting trigger pull may result from a mainspring and/or a recoil spring in the firearm. In some embodiments, a primary force resisting trigger pull may be a torsion spring acting around trigger pin 40, and a secondary force resisting trigger pull may result from trigger bias 32.

In one embodiment, the force required from a user in order to initiate pull back of the trigger, resulting directly from trigger bias 32, may be between 3 and 7 lbs. In other embodiments, the force required from a user in order to initiate pull back of the trigger, resulting directly from trigger bias 32, may be the greater than 7 lbs. Spring 43 biases trigger body 30 toward a forward or distal position, or resting position, and increases the force necessary to pull back on trigger body 30. Pulling back on trigger body 30 compresses spring 43 which yields a resistive force against rearward motion of trigger body 30. Spring 43 may create additional work for a user to pull back on trigger body 30. Spring 43 may provide an improvement in drop safety testing as spring 43 mechanically dampens trigger body 30 from rearward motion which may otherwise result in unintended firing. Trigger bias 32 may cause mechanical damping, i.e. restraining of vibratory motion, such as mechanical oscillations or noise, by dissipation of energy. Thus, spring 43 may bias trigger body 30 toward the resting state to prevent or dampen unintended movement of trigger body 30 towards the firing position when the pistol is dropped or subjected to a sudden force.

Structurally, trigger bias 32 may be a spring, cantilever spring, coil spring, volute spring, V-spring, constant-force spring, torsion spring, linear spring, or any mechanism that creates a bias in trigger body 30 such that additional force is required by a user to pull back on trigger body 30. Trigger body 30 has a proximal portion 38 that defines a recess or engagement surface 35 for trigger bias 32. In some embodiments, a proximal portion 38 of trigger body 30 is configured to receive a bolt 31, surrounded at least in part by a spring 43, and extending from a trigger stop, such as trigger pin 40 in the firearm receiver 45. The bolt 31 and/or the spring 43 may extend into an engagement surface 35 within trigger body 30. Engagement surface 35 may comprise a cylindrical region configured to house bolt 31 and/or spring 43. Engagement surface 35 may comprise a trigger block 60 at a distal portion 36 of trigger body 30. At a bottom portion of engagement surface 35, a bottom portion of the recess, or trigger block 60, may be configured to prevent further movement of bolt 31 and/or spring 43 within trigger body 30 as a user pulls rearwardly on trigger body 30. Trigger bias 32 can be positioned on a top portion, a bottom portion, or extend along the length of bolt 31. Trigger bias 32 may act on a proximal portion 54, a distal portion 55, or both of bolt 31 as it engages with trigger block 60 and trigger body 30. Bolt 31 may be wider at a proximal end and more narrow at a distal end, wider at a distal end and more narrow at a proximal end, or narrow enough that trigger bias 32 can surround bolt 31 along its length.

It is contemplated that the additional force required to pull back on trigger body 30 resulting from trigger bias 32 may occur throughout all rearward movement of trigger body 30. Alternately, it is contemplated that the additional force required to pull back on trigger body 30 resulting from trigger bias 32 may occur through only one, two, three, four, or five phases of rearward movement of the trigger. In some embodiments, trigger bias 32 or spring 43 may reach full compression during an initial phase of rearward movement of trigger body 30.

In some embodiments, spring 43 functions as trigger bias 32 and is compressed during initial pull back of the trigger. It may be desirable to increase an amount of trigger work with the addition of trigger bias 32 such that increased trigger work occurs for the entire length of trigger travel. Therefore, compression of trigger bias 32 may occur during each phase of trigger movement as described above.

Drop Safety Testing and Standard Safety Testing

It is contemplated that the slotted trigger actuation mechanism, trigger bias 32, or both, of the present disclosure may provide an improvement in drop safety testing results. Specifically, as a result of providing an increase in both trigger pull and trigger work required to actuate firing of ammunition, a firearm provided with the slotted trigger actuation mechanism, trigger bias 32, or both, may be statistically less likely to fire during a drop test. The inertia of the trigger on impact would be dampened by the compressive forces, increased trigger work, or both from trigger bias 32. Small movements of the trigger body 30 that are less than the distance required for the trigger body 30 to move the trigger bar 50, sear 70, or both would be statistically less likely to result in a discharge.

It is further contemplated that the standards set forth in Sporting Arms and Ammunition Manufacturers' Institute (SAAMI) standard safety testing, NATO EPVAT standard safety testing, as well as German safety standards would be met for firearms provided with the slotted trigger actuation mechanism, trigger bias 32, or both as described herein.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A firearm, comprising:

a firearm receiver; and a fire control group installed in the firearm receiver and comprising:

a striker configured to engage ammunition chambered in the firearm;

a sear mechanically coupled to the striker;

a trigger bar mechanically coupled to the sear; and a trigger assembly with a trigger body pivotable between a resting position and a firing position, the trigger bar configured with a slot extending parallel to a bore axis at an interface between the trigger body and the trigger bar, wherein the trigger body is configured to be movable between the resting position, an intermediate position and the firing position, the sear in a first position when the trigger body is in either the resting position or the intermediate position, and the sear is in a second position different from the first position when the trigger body is in the firing position, the intermediate position being at least 2 mm from each of the resting position and the firing position.

2. The firearm of claim 1, further comprising an arm connected to the trigger body and extending generally opposite of the trigger body from a pivot axis, the arm disposed in operational engagement with the trigger bar.

3. The firearm of claim 2, wherein the arm defines a protrusion extending generally parallel to the pivot axis and wherein the trigger bar defines a slot configured to receive the protrusion and guide the protrusion to move within the slot between a proximal slot end and a distal slot end.

4. The firearm of claim 2, wherein the trigger bar defines a protrusion extending generally parallel to the pivot axis and wherein the arm defines a slot configured to receive the protrusion and guide the protrusion to move within the slot between a proximal slot end and a distal slot end.

5. The firearm of claim 3, wherein the protrusion is configured to slide proximally and distally within the slot.

6. The firearm of claim 5, wherein the protrusion is configured to act as a fulcrum to lever trigger movement against an opposed motion of the trigger bar.

7. The firearm of claim 3, wherein the slot is an oval-shaped slot or a rectangular slot with two rounded ends.

8. The firearm of claim 1, wherein the spring is disposed between a trigger stop on the firearm receiver and a proximal portion of the trigger body.

9. A firearm, comprising:

a trigger body;

a sear, mechanically coupled to the trigger body; and a trigger bar configured with a slot extending parallel to a bore axis at an interface between the trigger body and the trigger bar, wherein the trigger body is configured to be movable between a resting position, an intermediate position and a firing position, the sear is in a first position when the trigger body is in either the resting position or the intermediate position, and the sear is in a second position different from the first position when the trigger body is in the firing position, the intermediate position being at least 2 mm from each of the resting position and the firing position.

10. The firearm of claim 9, wherein the trigger bar is in a first position when the trigger body is in either the resting position or the intermediate position, and the trigger bar is in a second position different from the first position when the trigger body is in the firing position.

11. The firearm of claim 9, wherein a proximal portion of the trigger body is configured to receive a bolt extending from a pin in a firearm receiver, surrounded at least in part by a spring.

12. The firearm of claim 11, wherein the spring is configured to require a pullback force of greater than about 7 lbs. to enable motion of the trigger body.

13. The firearm of claim 9, wherein only a portion of rearward trigger movement causes longitudinal movement of the trigger bar.

14. A method, comprising:

providing a firearm, comprising a firearm receiver, a fire control group installed in the firearm receiver and comprising a striker configured to engage ammunition chambered in the firearm, a sear, a trigger bar mechanically coupled to the sear, a trigger assembly with a trigger body pivotable between a resting position and a firing position, the trigger bar configured with a slot extending parallel to a bore axis at an interface between the trigger body and the trigger bar, wherein the trigger body is configured to be movable between a resting position, an intermediate position and a firing position, the sear is in a first position when the trigger body is in either the resting position or the intermediate position, and the sear is in a second position different from the first position when the trigger body is in the firing position, the intermediate position being at least 2 mm from each of the resting position and the firing position;

grasping the trigger body;

pulling back on the trigger body to a first distance;

pulling back on the trigger body to a second distance; and longitudinally moving the trigger bar only after the trigger body has been pulled back to the second distance.

15. The method of claim 14, wherein movement of the trigger body to the first distance does not result in trigger bar motion toward the sear.

16. The method of claim 14, wherein the first distance is about 3 mm and the second distance is about 5 mm.

17. The method of claim 14, wherein the sear is mechanically coupled to at least one of the trigger body and the striker.

18. The method of claim 14, further comprising actuating the sear only after the trigger body has been pulled back to the second distance.

19. The method of claim 18, wherein a second slot is positioned directly in the sear to facilitate a two-stage trigger activation.

* * * * *